US007486258B2

(12) United States Patent
Baik et al.

(10) Patent No.: US 7,486,258 B2
(45) Date of Patent: Feb. 3, 2009

(54) METHOD OF DRIVING PLASMA DISPLAY PANEL

(75) Inventors: Joon-Suk Baik, Suwon-si (KR); Geun-Yeong Chang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 558 days.

(21) Appl. No.: 10/986,132

(22) Filed: Nov. 12, 2004

(65) Prior Publication Data

US 2005/0140580 A1 Jun. 30, 2005

(30) Foreign Application Priority Data

Nov. 24, 2003 (KR) ..... 10-2003-0083634

(51) Int. Cl.
*G09G 3/28* (2006.01)

(52) U.S. Cl. ..... 345/60; 345/63

(58) Field of Classification Search ..... 345/60
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| RE37,444 | E | 11/2001 | Kanazawa | |
| 6,396,508 | B1 * | 5/2002 | Noecker | 345/693 |
| 6,476,801 | B2 * | 11/2002 | Nagai | 345/213 |
| 6,630,916 | B1 | 10/2003 | Shinoda | |
| 6,690,388 | B2 * | 2/2004 | Kasahara et al. | 345/690 |

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003,and Appendix A—Description of Technology, Annex B—Relationship Between Voltage Terms And Discharge Characteristics; Annex C—Gaps and Annex D—Manufacturing.

(Continued)

*Primary Examiner*—Sumati Lefkowitz
*Assistant Examiner*—Grant D Sitta
(74) *Attorney, Agent, or Firm*—Robert E. Bushnell, Esq.

(57) ABSTRACT

A method of driving a plasma display panel (PDP) is provided. In the method, the number of sustain pulses to be applied during a sustain period for each subfield in a frame is calculated. In order to achieve better image quality, fractional parts of the number of calculated sustain pulses is not disregarded but used by adding this fractional part to the appropriate count for a comparable subfield in a subsequent frame. By including this calculated fractional part in the calculations, a better image quality can be realized where there is less distortion.

10 Claims, 11 Drawing Sheets

U.S. PATENT DOCUMENTS

| | | | | |
|---|---|---|---|---|
| 6,707,436 | B2 | 3/2004 | Setoguchi et al. | |
| 7,420,571 | B2 * | 9/2008 | Lee et al. | 345/616 |
| 2005/0140584 | A1 * | 6/2005 | Kim et al. | 345/60 |

FOREIGN PATENT DOCUMENTS

| | | | |
|---|---|---|---|
| JP | 2845183 | | 10/1998 |
| JP | 11-052913 | | 2/1999 |
| JP | 2917279 | | 4/1999 |
| JP | 2001-043804 | | 2/2001 |
| JP | 2001-075530 | | 3/2001 |
| JP | 2001-228824 | * | 8/2001 |
| JP | 2001-325888 | | 11/2001 |
| JP | 2003-271091 | | 9/2003 |

OTHER PUBLICATIONS

*Office action* from the Japanese Patent Office issued in Applicant's corresponding Japanese Patent Application No. 2004-337518 dated Oct. 9, 2007.

* cited by examiner

METHOD OF DRIVING PLASMA DISPLAY PANEL

CLAIM OF PRIORITY

This application claims the priority of Korean Patent Application No. 2003-83634, filed on Nov. 24, 2003, in the Korean Intellectual Property Office, the disclosure of which is incorporated herein in its entirety by reference.

BACKGROUND OF THE INVENTION

1. Field of the Invention

The present invention relates to a method of driving a plasma display panel (PDP), and more particularly, to a method of driving a PDP, in which an error of a fractional part occurring in a result of calculating a number of sustain pulses in a subfield in a frame is added to a number of sustain pulses in the corresponding subfield in a subsequent frame to compensate for distortion in a grayscale caused by the error of the fractional part, thus enhancing grayscale display capability of the PDP.

2. Description of the Related Art

An address-display separation driving method for the PDP 1 having such a structure is disclosed in U.S. Pat. No. 5,541,618 to Shinoda. The method includes dividing each of frames of input video data temporally into a plurality of the subfields, each subfield having unique grayscale weights, respectively, to perform time division grayscale display, each of the subfields having a reset period, an address period, and a sustain period during which a predetermined number of sustain pulses are alternately applied to the Y-electrode lines and the X-electrode lines, and applying a predetermined number of sustain pulses to the sustain electrode line pairs during the sustain period in each subfield. The applying of the predetermined number of sustain pulses includes calculating a number of sustain pulses for each subfield.

In calculating the number of sustain pulses to be applied in a subfield of a frame, the result is often made up of an integral part and a fractional part. In general, this fractional part is ignored, thus causing an imperfect image, such as distortion. Therefore, what is needed is an improved method for calculating the number of sustain pulses to be applied in a subfield that results in less distortion.

SUMMARY OF THE INVENTION

It is therefore an object of the present invention to provide an improved method of determining the number of sustain pulses to be applied in each subfield for a PDP.

It is further an object to provide a PDP that reduces distortion by better calculating the number of sustain pulses for each subfield.

It is still an object of the present invention to provide a method of calculating the number of pulses in a subfield that includes the fractional part in the determination of the number of pulses to be applied.

These and other objects can be achieved by a method of driving a plasma display panel (PDP), so that an error being a fractional part occurring in a result of calculating a number of sustain pulses in a subfield in a frame is added to a number of sustain pulses in the corresponding subfield in a subsequent frame to compensate for distortion in a grayscale caused by the error of the fractional part, thus enhancing grayscale display capability of the PDP.

According to an aspect of the present invention, there is provided method of driving a PDP including sustain electrode line pairs, in which X-electrode lines and Y-electrode lines alternate with each other in parallel, and address electrode lines that cross the sustain electrode line pairs, thus forming cells at intersections therebetween. The method includes dividing each of frames of input video data temporally into a plurality of subfields having unique grayscale weights, respectively, to perform time division grayscale display, each of the subfields having a reset period, an address period, and a sustain period during which a predetermined number of sustain pulses are alternately applied to the Y-electrode lines and the X-electrode lines, and applying a predetermined number of sustain pulses to the sustain electrode line pairs during the sustain period in each subfield. The applying of the predetermined number of sustain pulses includes calculating a number of sustain pulses for each subfield in a current frame using a total number of sustain pulses in the current frame and the unique grayscale weights allocated to the respective subfields in the current frame, thus obtaining a calculated sustain pulse number made up of an integral part and a fractional part, adding the calculated sustain pulse number in the subfield included in the current frame and a fractional part of an adjusted sustain pulse number in a subfield having the same unique grayscale weight from a previous frame as the subfield in the current frame, thus obtaining an adjusted sustain pulse number in the subfield in the current frame, the adjusted sustain pulse number includes an integral part and a fractional part and applying the integral part of the adjusted sustain pulse number in the subfield in the current frame as a number of sustain pulses applied to each of the Y-electrode lines and the X-electrode lines in the subfield in the current frame.

The applying of the predetermined number of sustain pulses may further include detecting a load ratio of a number of cells to be turned on to a total number of the cells on the PDP from the video data, and determining the total number of sustain pulses in the current frame to be in inverse proportion to the detected load ratio.

The calculated sustain pulse number in the subfield in the current frame may be obtained by multiplying the total number of sustain pulses in the current frame by the unique grayscale weight allocated to the subfield and dividing a result of the multiplication by a sum of the unique grayscale weights to the respective subfields in the current frame.

According to another aspect of the present invention, there is provided an apparatus for driving a PDP including sustain electrode line pairs, in which X-electrode lines and Y-electrode lines alternate with each other in parallel, and address electrode lines cross the sustain electrode line pairs, thus forming cells at intersections therebetween. The apparatus divides each of frames of input video data into a plurality of subfields having unique grayscale weights, respectively, to perform time division grayscale display, each of the subfields having a reset period, an address period, and a sustain period during which a predetermined number of sustain pulses are alternately applied to the Y-electrode lines and the X-electrode lines, and applies a predetermined number of sustain pulses to the sustain electrode line pairs during the sustain period in each subfield. The apparatus includes a subfield sustain pulse number calculator calculating a number of sustain pulses in each of the subfields in a current frame using a total number of sustain pulses in the current frame and the unique grayscale weights allocated to the respective subfields in the current frame, thus obtaining a calculated sustain pulse number made up of an integral part and a fractional part, a sustain pulse number adjustor adding the calculated sustain pulse number in the subfield included in the current frame to a fractional part of an adjusted sustain pulse number in a subfield having the same unique grayscale weight in a previous frame as the subfield in the current frame, thus obtaining an adjusted sustain pulse number in the subfield in the current frame. This adjusted sustain pulse number includes an integral part and a fractional part. The sustain pulse number using the integral part of the adjusted sustain pulse number in the subfield in the current frame as a number of sustain pulses to be applied to each of the Y-electrode lines and the X-electrode lines in the subfield in the current frame.

The apparatus may further include a load ratio detector detecting a load ratio of a number of cells to be turned on to a total number of the cells on the PDP from the video data, and a load-ratio sustain pulse number determiner determining the total number of sustain pulses in the current frame to be in proportion to an inverse of the detected load ratio. According to the present invention, distortion in a grayscale caused by an error of a fractional part occurring in a result of calculating a number of sustain pulses can be taken into account in the calculation of the number of sustain pulses, thus enhancing grayscale display capability.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
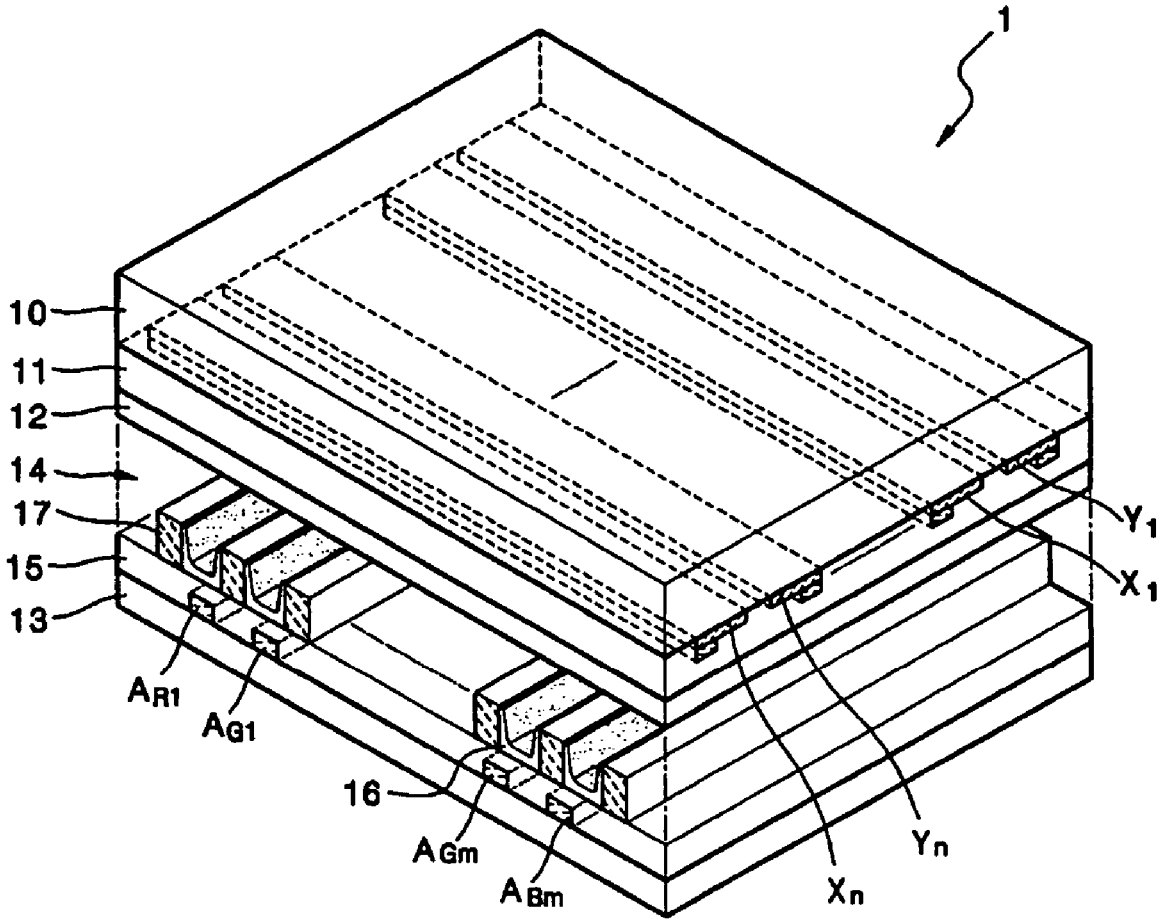
FIG. 1 is an internal perspective view showing the structure of a surface discharge type triode plasma display panel (PDP)
Figure 2:
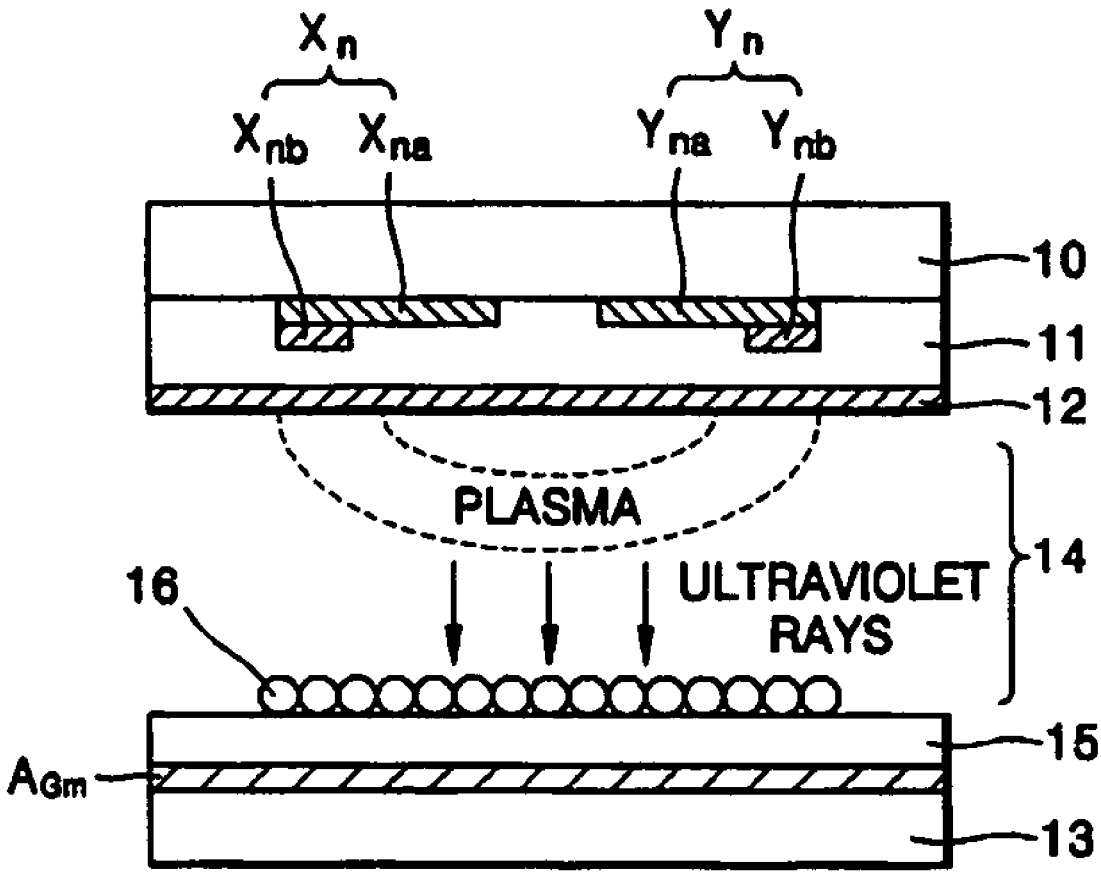
FIG. 2 is a cross-section of a display cell on the PDP shown in FIG. 1.

Turning now to FIGS. 1 and 2, FIG. 1 is an internal perspective view showing the structure of a surface discharge type triode PDP and FIG. 2 is a cross-section of a display cell on the PDP shown in FIG. 1. Address electrode lines $A_{R1}$, $A_{G1}, \ldots, A_{Gm}, A_{Bm}$, dielectric layers 11 and 15, Y-electrode lines $Y_1, \ldots, Y_n$, X-electrode lines $X_1, \ldots, X_n$, phosphor layers 16, partition walls 17, and a magnesium oxide (MgO) layer 12 as a protective layer are provided between front and rear glass substrates 10 and 13 of a general surface discharge PDP 1.

The address electrode lines $A_{R1}$ through $A_{Bm}$ are formed on the front surface of the rear glass substrate 13 in a predetermined pattern. A rear dielectric layer 15 is formed on the entire surface of the rear glass substrate 13 over the address electrode lines $A_{R1}$ through $A_{Bm}$. The partition walls 17 are formed on the front surface of the rear dielectric layer 15 to be parallel to the address electrode lines $A_{R1}$ through $A_{Bm}$. These partition walls 17 define the discharge areas of respective discharge cells and serve to prevent cross talk between discharge cells. The phosphor layers 16 are formed between partition walls 17.

The X-electrode lines $X_1$ through $X_n$ and the Y-electrode lines $Y_1$ through $Y_n$ are formed on the rear surface of the front glass substrate 10 in a predetermined pattern to be orthogonal to the address electrode lines $A_{R1}$ through $A_{Bm}$. The respective intersections define discharge cells. Each of the X-electrode lines $X_1$ through $X_n$ is made up of a transparent electrode line $X_{na}$ (FIG. 2) formed of a transparent conductive material, e.g., indium tin oxide (ITO), and a metal electrode line $X_{nb}$ (FIG. 2) for increasing conductivity. Each of the Y-electrode lines $Y_1$ through $Y_n$ is made up of a transparent electrode line $Y_{na}$ (FIG. 2) formed of a transparent conductive material, e.g., ITO, and a metal electrode line $Y_{nb}$ (FIG. 2) for increasing conductivity. A front dielectric layer 11 is deposited on the entire rear surface of the front glass substrate 10 and over the rear surfaces of the X-electrode lines $X_1$ through $X_n$ and the Y-electrode lines $Y_1$ through $Y_n$. The protective layer 12, e.g., a MgO layer, for protecting the panel 1 against a strong electrical field is deposited on the entire surface of the front dielectric layer 11. A gas for forming plasma is hermetically sealed in a discharge space 14.

Figure 3:
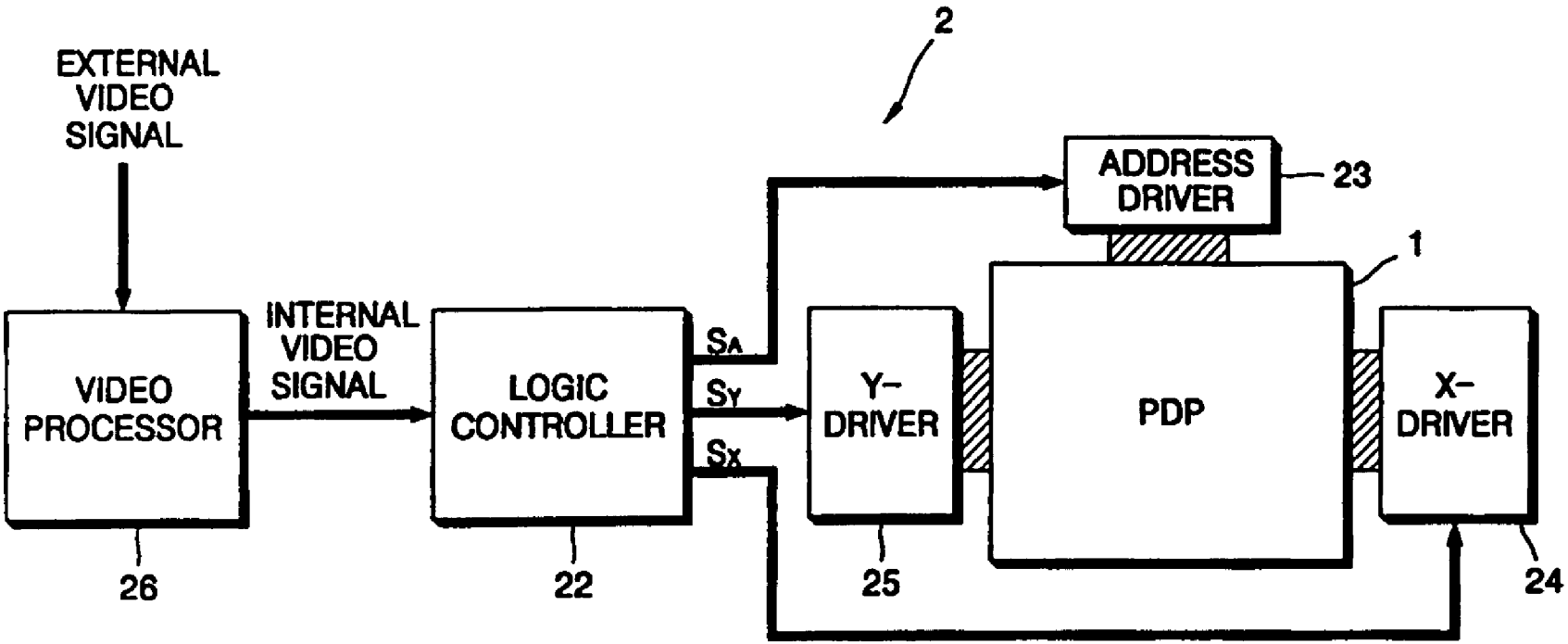
FIG. 3 is a block diagram of a typical driving apparatus for the PDP shown in FIG. 1.

Turning now to FIG. 3, FIG. 3 is a block diagram of a typical driving apparatus 2 for the PDP 1 shown in FIG. 1. Referring to FIG. 3, the typical driving apparatus 2 for the PDP 1 includes a video processor 26, a logic controller 22, an address driver 23, an X-driver 24, and a Y-driver 25. The video processor 26 converts an external analog video signal into a digital signal to generate an internal video signal made up of, for example, 8-bit red (R) video data, 8-bit green (G) video data, 8-bit blue (B) video data, a clock signal, a horizontal synchronizing signal, and a vertical synchronizing signal. The logic controller 22 generates drive control signals $S_A$, $S_Y$, and $S_X$ in response to the internal video signal from the video processor 26.

The address driver 23, the X-driver 24, and the Y-driver 25 receive the drive control signals $S_A$, $S_X$, and $S_Y$, respectively, generate driving signals in response to the drive control signals $S_A$, $S_X$, and $S_Y$, respectively, and apply the driving signals, respectively, to corresponding electrode lines. In other words, the address driver 23 processes the address signal $S_A$ among the drive control signals $S_A$, $S_Y$, and $S_X$ output from the logic controller 22 to generate a display data signal and applies the display data signal to address electrode lines. The X-driver 24 processes the X-drive control signal $S_X$ among the drive control signals $S_A$, $S_Y$, and $S_X$ output from the logic controller 22 and applies the result of the processing to X-electrode lines. The Y-driver 25 processes the Y-drive control signal $S_Y$ among the drive control signals $S_A$, $S_Y$, and $S_X$ output from the logic controller 22 and applies the result of the processing to Y-electrode lines.

Figure 4:
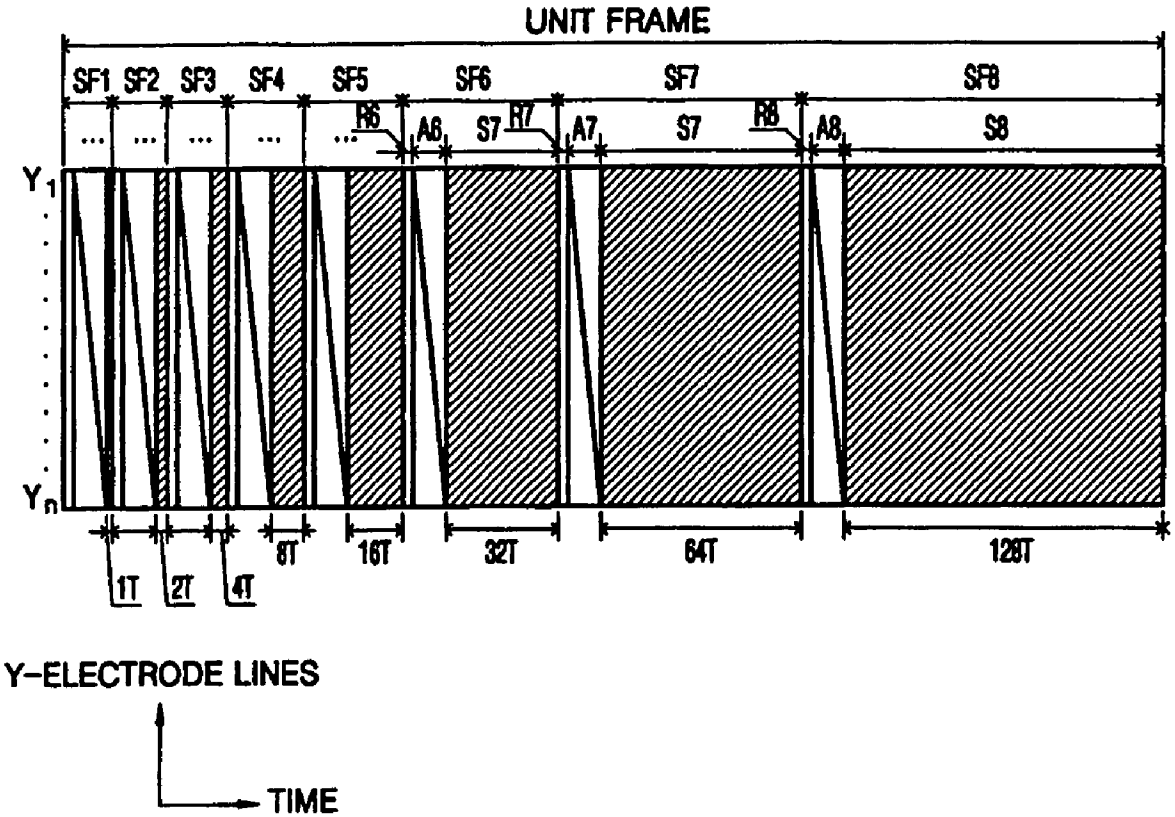
FIG. 4 is a timing chart illustrating a method of driving the PDP shown in FIG. 1.

Turning to FIG. 4, FIG. 4 is a timing chart illustrating a method of driving the PDP 1 shown in FIG. 1. Referring to FIG. 4, to realize time-division grayscale display, a unit frame is divided into 8 subfields SF1 through SF8. In addition, the individual subfields SF1 through SF8 are made up of reset periods R1 through R8, respectively, address periods A1 through A8, respectively, and sustain periods S1 through S8, respectively.

The brightness of the PDP 1 is proportional to a total length of the sustain periods S1 through S8 in the unit frame. The total length of the sustain periods S1 through S8 in the unit frame is 255T (T is a unit time). Here, a sustain period Sn of an n-th subfield SFn is set to a time corresponding to $2^{n-1}$. Accordingly, if subfields to be displayed are appropriately selected from among the 8 subfields SF1 through SF8, a total of 256 grayscales including a gray level of zero at which display is not performed in any subfield can be displayed.

Figure 5:
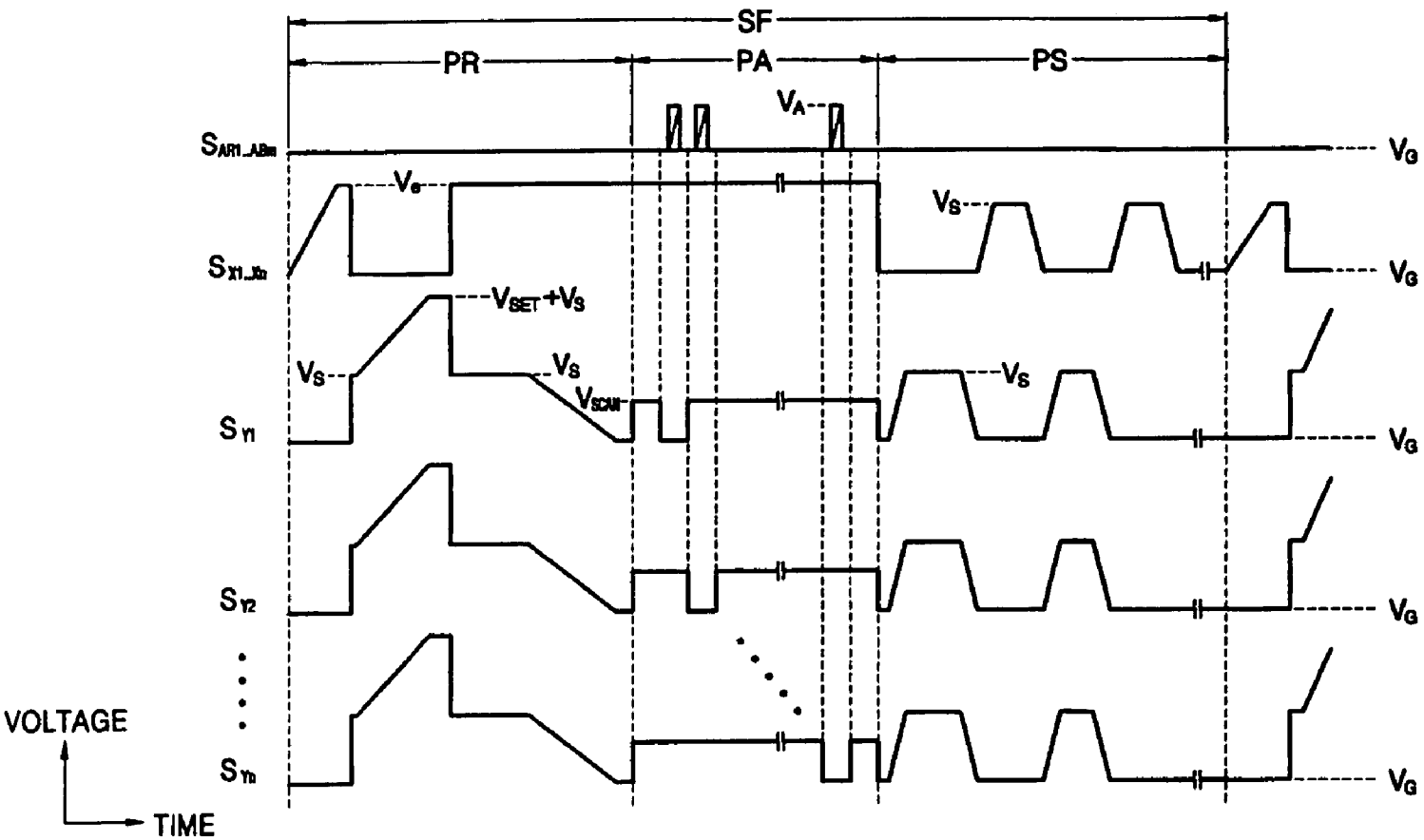
FIG. 5 is a timing chart of a unit subfield of FIG. 4 of driving signals applied to electrode lines on the PDP shown in FIG. 1.

Turning now to FIG. 5, FIG. 5 is a timing chart of driving signals applied to the electrode lines on the PDP 1 shown in FIG. 1 in the unit frame shown in FIG. 4. In FIG. 5, a reference character $S_{AR1} \ldots S_{ABm}$ denotes a driving signal applied to the address electrode lines $A_{R1}$ through $A_{Bm}$ shown in FIG. 1. A reference character $S_{X1} \ldots S_{Xn}$ denotes a driving signal applied to the X-electrode lines $X_1$ through $X_n$ shown in FIG. 1. Reference characters $S_{Y1} \ldots S_{Yn}$. denotes driving signals applied to the Y-electrode lines $Y_1$ through $Y_n$, respectively, shown in FIG. 1.

Referring to FIG. 5, during a reset period PR of an individual subfield SF, a voltage applied to the X-electrode lines $X_1$ through $X_n$ is continuously increased from a ground voltage $V_G$ to a first voltage $V_e$, for example, 155 V. Here, the ground voltage $V_G$ is applied to the Y-electrode lines $Y_1$ through $Y_n$ and the address electrode lines $A_{R1}$ through $A_{Bm}$.

Next, the voltage applied to the Y-electrode lines $Y_1$ through $Y_n$ is continuously increased from a second voltage $V_S$, for example, 155 V, to a maximum voltage $V_{SET}+V_S$, for example, 355 V, higher than the second voltage $V_S$ by a third voltage $V_{SET}$. Here, the ground voltage $V_G$ is applied to the X-electrode lines $X_1$ through $X_n$ and the address electrode lines $A_{R1}$ through $A_{Bm}$.

Next, the voltage applied to the Y-electrode lines $Y_1$ through $Y_n$ is continuously decreased from the second voltage $V_S$ to the ground voltage $V_G$ while the voltage applied to the X-electrode lines $X_1$ through $X_n$ is maintained at the first voltage $V_e$. Here, the ground voltage $V_G$ is applied to the address electrode lines $A_{R1}$ through $A_{Bm}$.

Accordingly, during a subsequent address period PA, display data signals are applied to the address electrode lines $A_{R1}$ through $A_{Bm}$, and a scan signal having the ground voltage $V_G$ is sequentially applied to the Y-electrode lines $Y_1$ through $Y_n$ biased to a fourth voltage $V_{SCAN}$ lower than the second voltage $V_S$, so that addressing can be smoothly performed. Here, display data signals for selecting a discharge cell have a positive address voltage $V_A$, and the others have the ground voltage $V_G$. Accordingly, when a display data signal having the positive address voltage $V_A$ is applied while a scan pulse having the ground voltage $V_G$ is being applied, wall charges are induced by address discharge in a corresponding discharge cell. However, wall charges are not formed in otherwise discharge cells. Here, to accomplish more accurate and efficient address discharge, the first voltage $V_e$ is applied to the X-electrode lines $X_1$ through $X_n$.

During a subsequent sustain period PS, a sustain pulse having the second voltage $V_S$ is alternately applied to the Y-electrode lines $Y_1$ through $Y_n$ and the X-electrode lines $X_1$ through $X_n$, thus provoking display discharge in discharge cells in which wall charges are induced during the address period PA.

The number of sustain pulses in a frame is determined according to a brightness of an input image. As shown in FIG. 4, numbers of sustain pulses in the respective subfields within the unit frame are determined according to grayscale weights used to display the brightness of the input image. The image represented by a grayscale in the unit frame is displayed using the subfields having the respective grayscale weights. In other words, the image is displayed using a number of sustain pulses in each subfield determined based on the number of sustain pulses in the unit frame and the grayscale weights allocated to the respective subfields.

Figure 6:
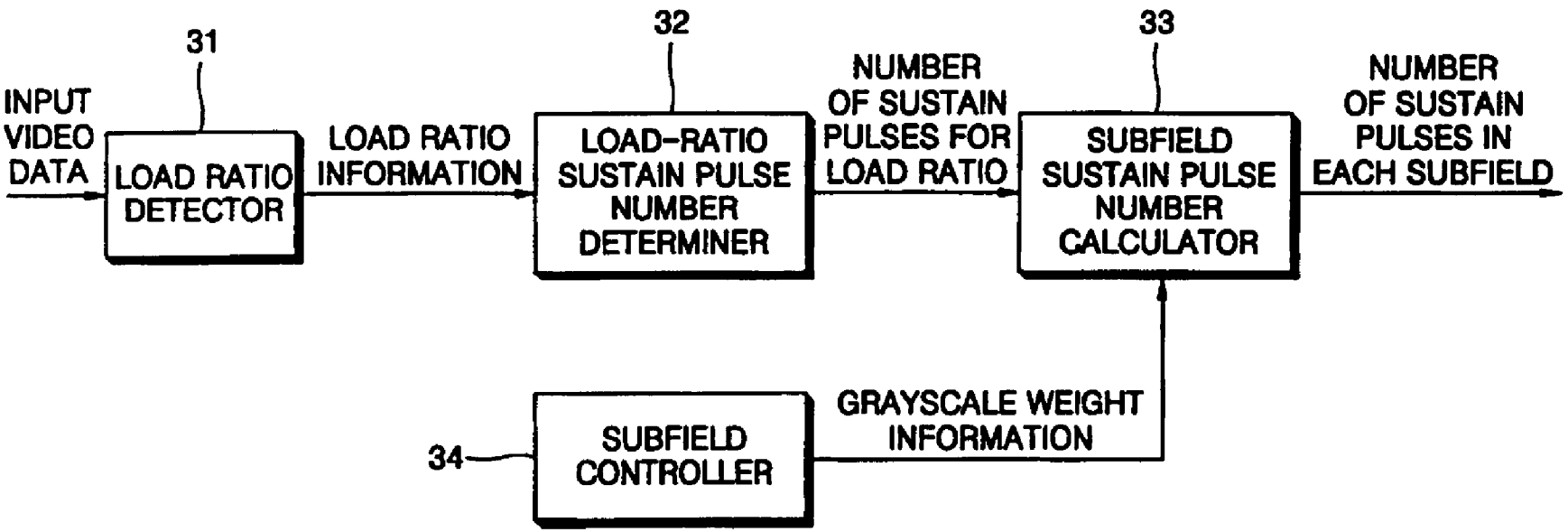
FIG. 6 is a schematic block diagram of an apparatus for performing a method of calculating a number of sustain pulses to be applied to each of subfields included in a frame.
Figure 7:
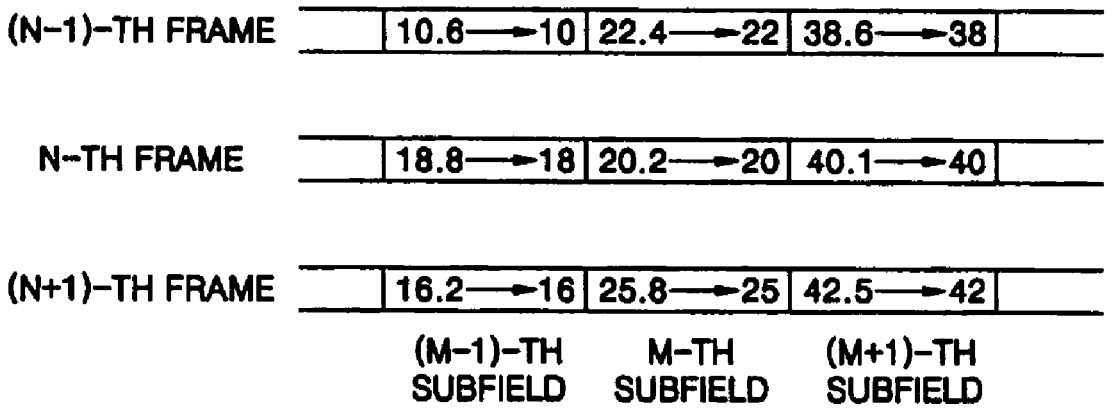
FIG. 7 illustrates an example of generating a calculated number of sustain pulses in each subfield using the apparatus shown in FIG. 6.

Turning now to FIGS. 6 and 7, FIG. 6 is a schematic block diagram of an apparatus for performing a method of generating a number of sustain pulses for each subfields in a frame. FIG. 7 illustrates an example of generating a number of sustain pulses for each subfield using calculation in the method performed by the apparatus shown in FIG. 6.

Referring to FIGS. 6 and 7, The number of sustain pulses for the entire frame iis determined according to a load ratio on the frame to be displayed. The number of sustain pulses in each of the subfields in a frame is obtained using a grayscale weights allocated to each subfield. The load ratio is a ratio of a number of cells to be turned on to display the image to a total number of cells on a PDP. In detail, a load ratio detector 31 detects a load ratio for each frame from the input video data. A load-ratio sustain pulse number determiner 32 obtains a number of pulses for a load ratio on each frame using load ratio information received from the load ratio detector 31. A subfield sustain pulse number calculator 33 obtains a number of sustain pulses in each of subfields for a frame using the number of sustain pulses for the load ratio for the entire frame that is received from the load-ratio sustain pulse number determiner 32 and subfield grayscale weight information received from a subfield controller 34. The number of sustain pulses in each subfield is input to a driving controller, which generates and outputs driving control signals to an X-driver, a Y-driver, and an address driver to drive electrodes on the PDP.

In the method of generating a number of sustain pulses in each of subfields included in a frame, a number of sustain pulses in the entire frame is determined according to a load ratio on the frame, and a number of sustain pulses in each subfield may be obtained from a coding table that stores a number of sustain pulses for each subfield corresponding to a load ratio on a frame. In this case, although time needed for calculation can be reduced, memory space for the coding table is additionally needed.

FIG. 7 illustrates an example of obtaining the number of sustain pulses for each subfield in a frame by calculation. Each result includes an integral part and a fractional part. However, a number of sustain pulses can be represented by only the integral part. As a result, an error corresponding to the fractional part may occur in grayscale display.

Figure 8:
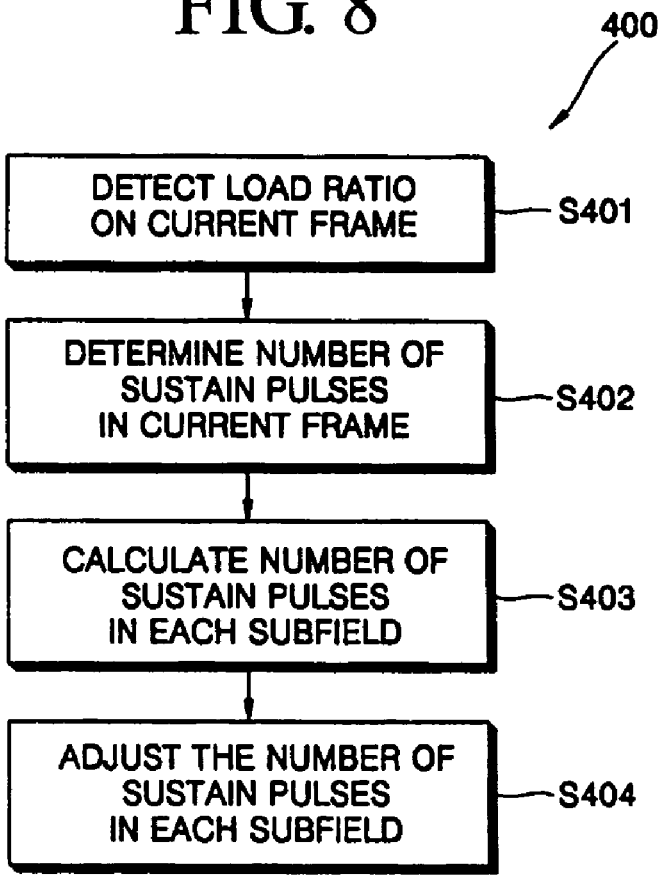
FIG. 8 is a schematic block diagram of a method of determining a number of sustain pulses to be applied in each of subfields included in a frame according to an embodiment of the present invention.
Figure 9:
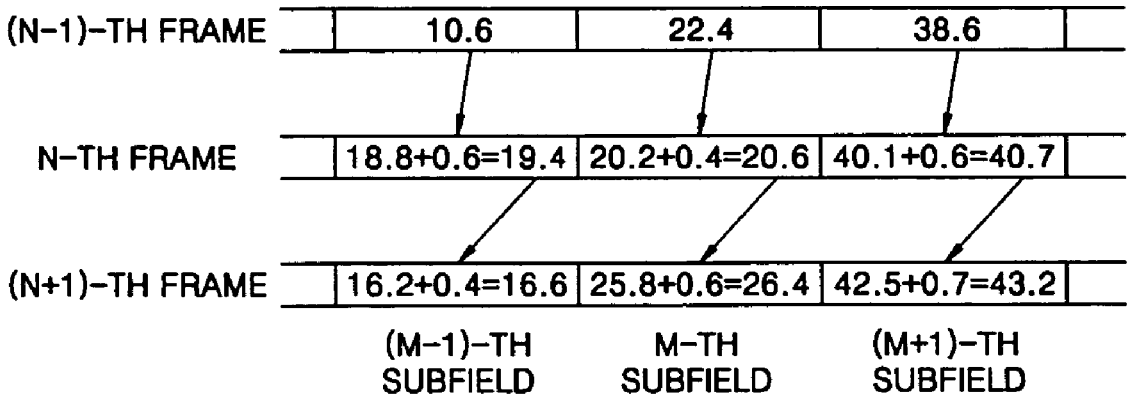
FIG. 9 illustrates an example of how the number of sustain pulses in each subfield is calculated using the method shown in FIG. 8.

Turning now to FIGS. 8 and 9, FIG. 8 is a schematic block diagram of a method of generating a number of sustain pulses in each subfield in a frame according to an embodiment of the present invention. FIG. 9 illustrates an example of how the number of sustain pulses for each subfield are determined using the method of FIG. 8.

A plasma display panel (PDP 1 shown in FIG. 1) includes sustain electrode line pairs, in which the X-electrode lines $X_1$ through $X_n$ shown in FIG. 1 and the Y-electrode lines $Y_1$ through $Y_n$ shown in FIG. 1 alternate with each other in parallel, and the address electrode lines $A_{R1}$ through $A_{Bm}$ shown in FIG. 1, which cross the sustain electrode line pairs, thus forming cells at intersections therebetween. Each of frames of input video data is divided into a plurality of the subfields SF1 through SF8 shown in FIG. 4 having unique grayscale weights, respectively, to perform time division grayscale display. Each of the subfields SF1 through SF8 is made p of the reset period PR, the address period PA, and the sustain period PS shown in FIG. 5. During the sustain period PS, a predetermined number of sustain pulses are alternately applied to the Y-electrode lines $Y_1$ through $Y_n$ and the X-electrode lines $X_1$ through $X_n$ shown in FIG. 1. With such an arrangement, a method 400 of driving the PDP according to an embodiment of the present invention includes calculating a number of sustain pulses in each subfield included in a current frame in operation S403 and adjusting the number of sustain pulses in each subfield in operation S404.

The method 400 may further include detecting a load ratio for the current frame from the input video data in operation S401 and determining a number of sustain pulses in the current frame such that the number of sustain pulses in the current frame is in inverse proportion to the load ratio for the frame in operation S402. Here, the load ratio is a ratio of a number of cells to be turned on during the current frame to a total number of the cells on the PDP.

In operation S403 of FIG. 8, the number of sustain pulses for each subfield (SF shown in FIG. 5) included in the current frame is calculated from a number of sustain pulses in the current frame based on grayscale weights allocated to the respective subfields in the current frame. The number of sustain pulses in each subfield obtained through the calculation is referred to as a calculated sustain pulse number. The calculated sustain pulse number is not always exactly equal to a whole number, so the calculated sustain pulse number is made up of an integral part and a fractional part, as shown in FIG. 9. Since the calculated sustain pulse number indicating a number of sustain pulses applied to each of the Y-electrode lines $Y_1$ through $Y_n$ and the X-electrode lines $X_1$ through $X_n$ during the sustain period PS includes both integer number (or whole number) and a fractional part (or decimal part), the calculated sustain pulse number cannot be perfectly represented during the sustain period PS since it is impossible to apply a fractional of a pulse in any subfield. It is therefore necessary to separately consider the integral part and the fractional part of the calculated sustain pulse number.

The calculated sustain pulse number $N_{SF}(n)$ in each field SF can be expressed by the following equation:

$$N_{SF}(n) = N_{FR} \times \frac{W_{SF}(n)}{\sum_{n=1}^{n\,\max} W_{SF}(n)}.$$

Here, $N_{FR}$ denotes the number of sustain pulses in the entire frame, $W_{SF}(n)$ denotes a grayscale weight allocated to each subfield SF, and nmax denotes a number of subfields included in the current frame. As can be seen from the above equation, the numerator $W_{SF}(n)$ is the grayscale weight for the $n^{th}$ subfield and the sum in the denominator is the sum of all the grayscale weights of each subfield for an entire frame. Thus, this fractional represents the fractional of greyscale weights that occur in the nth subfield for the entire frame. It is to be appreciated that in general, the number of calculated sustain pulses $N_{SF}$ (n) for the $n^{th}$ subfield is an integer plus a fractional as opposed to just an integer. It is in how this calculated fractional is dealt with that is the subject of the present invention.

Figure 12:
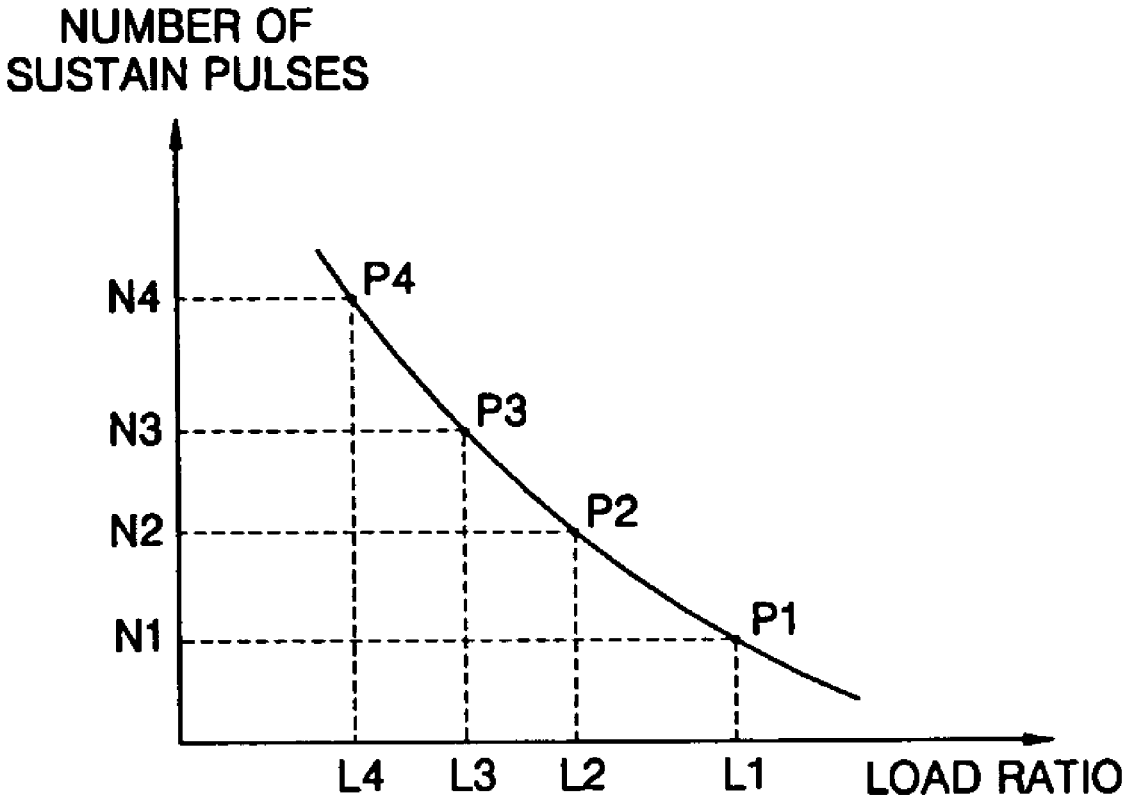
FIG. 12 is a schematic graph illustrating automatic power control performed by the apparatus shown in FIG. 10 or 11.

A number of sustain pulses in each frame may be fixed in advance. However, when the PDP is under automatic power control to control power consumption when necessary, the method 400 may further include operations S401 and S402 where $N_{FR}$, the number of sustain pulses for the entire frame, are calculated. In operation S401, a load ratio is detected from the input image data in units of frames. The load ratio is a ratio of a number of cells to be turned on in each frame to a total number of the cells on the PDP. In operation S402, a number of sustain pulses in each frame is determined from the reciprocal of the load ratio, as shown in FIG. 12 to be described later.

In operation S404, a calculated sustain pulse number in a subfield included in the current frame and a fractional part of an adjusted sustain pulse number in a previous frame of a subfield having the same grayscale weight as the subfield in the current frame are added up, thus obtaining an adjusted sustain pulse number in the current subfield of the current frame. The adjusted sustain pulse number also includes an integral part and a fractional part like the calculated sustain pulse number. Here, an adjusted sustain pulse number in a subfield of a current frame is the sum of a fractional part of an adjusted sustain pulse number in a subfield having the same grayscale weight as in a previous frame as the subfield in the current frame and a calculated sustain pulse number in the subfield in the current frame. By doing so, the fractional part of the calculated number of sustain pulses of a subfield is taken into account and thus resulting in an image with less distortion than when the fractional part of the calculated number of sustain pulses for a subfield is entirely disregarded.

In operation 404 of FIG. 8, a number of sustain pulses to be applied (hereinafter, referred to as an applied sustain pulse number) in each of the subfields in the current frame is also obtained using the adjusted sustain pulse number in each subfield in the current frame. Since the applied sustain pulse number indicating a number of sustain pulses applied to each of the Y-electrode lines $Y_1$ through $Y_n$ and the X-electrode lines $X_1$ through $X_n$ in each subfield must be an integer number, an integral part of the adjusted sustain pulse number in each subfield in the current frame becomes the applied sustain pulse number in the subfield in the current frame.

An example of determining the applied sustain pulse number in each subfield will be described with reference to FIG. 9. In a current frame, i.e., an N-th frame, a calculated sustain pulse number in a (M−1)-th subfield is 18.8, a calculated sustain pulse number in an M-th subfield is 20.2, and a calculated sustain pulse number in a (M+1)-th subfield is 40.1.

In a previous frame, i.e., a (N−1)-th frame, an adjusted sustain pulse number in the (M−1)-th subfield is 10.6, an adjusted sustain pulse number in the M-th subfield is 22.4, and an adjusted sustain pulse number in the (M+1)-th subfield is 38.6. In the (N−1) frame, a fractional part of the adjusted sustain pulse number in the (M−1)-th subfield is 0.6; a fractional part of the adjusted sustain pulse number in the M-th subfield is 0.4; and a fractional part of the adjusted sustain pulse number in the (M+1)-th subfield is 0.6.

Accordingly, in the N-th frame, an adjusted sustain pulse number in the (M−1)-th subfield is 18.8+0.6=19.4, an adjusted sustain pulse number in the M-th subfield is 20.2+0.4=20.6, and a adjusted sustain pulse number in the (M+1)-th subfield is 40.1+0.6=40.7. As a result, in the N-th frame, an applied sustain pulse number in the (M−1)-th subfield is an integral part of the adjusted sustain pulse number in the (M−1)-th subfield, i.e., 19. An applied sustain pulse number in the M-th subfield is an integral part of the adjusted sustain pulse number in the M-th subfield, i.e., 20. An applied sustain pulse number in the (M+1)-th subfield is an integral part of the adjusted sustain pulse number in the (M+1)-th subfield, i.e., 40. Here, a fractional part of the adjusted sustain pulse number in each subfield in the N-th frame is not reflected to the applied sustain pulse number but is added to a calculated sustain pulse number in a corresponding subfield in a subsequent frame, i.e., a (N+1)-th frame, thus generating an adjusted sustain pulse number in the corresponding subfield in the (N+1)-th frame.

As described above, since a fractional part of a calculated sustain pulse number in a subfield in a current frame is not reflected to an applied sustain pulse number in the current frame but is reflected to an adjusted sustain pulse number in the same subfield in a subsequent frame, a grayscale can be accurately displayed. In particular, distortion in a low grayscale greatly affected by a number of sustain pulses can be prevented, thus enhancing low grayscale display capability.

Figure 10:
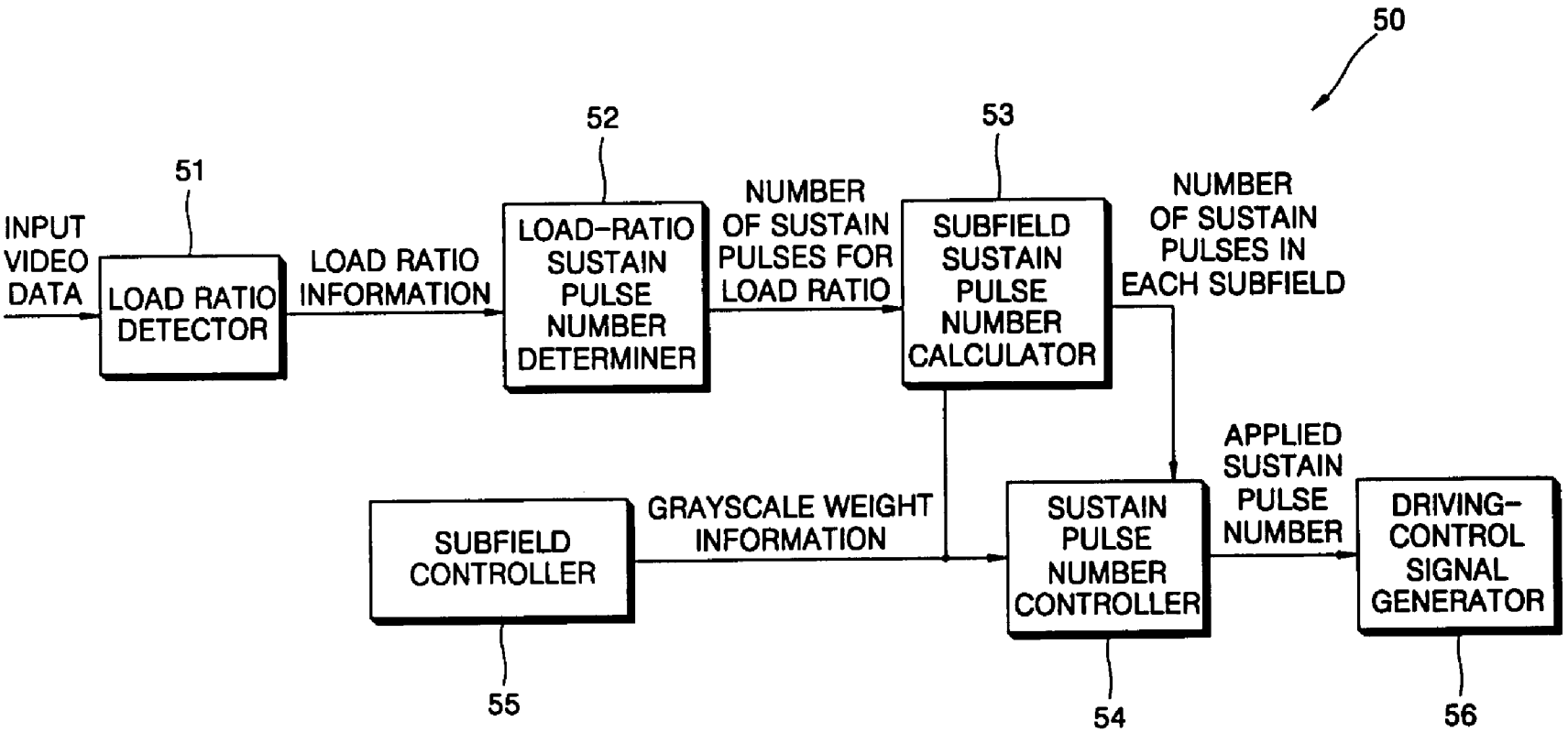
FIG. 10 is a schematic block diagram of an apparatus for driving a PDP that uses the method of FIG. 8, according to an embodiment of the present invention.

FIG. 10 is a schematic block diagram of an apparatus for driving a PDP, by which the method 400 of FIG. 8 is performed, according to an embodiment of the present invention. The PDP includes sustain electrode line pairs, in which the X-electrode lines $X_1$ through $X_n$ shown in FIG. 1 and the Y-electrode lines $Y_1$ through $Y_n$ shown in FIG. 1 alternate with each other in parallel, and the address electrode lines $A_{R1}$ through $A_{Bm}$ shown in FIG. 1, which cross the sustain electrode line pairs, thus forming cells at intersections therebetween. Each of frames of input video data is divided into a plurality of the subfields SF1 through SF8 shown in FIG. 4 having unique grayscale weights, respectively, to perform time division grayscale display. Each of the subfields SF1 through SF8 is made up of the reset period PR, the address period PA, and the sustain period PS shown in FIG. 5. During the sustain period PS, a predetermined number of sustain pulses are alternately applied to the Y-electrode lines $Y_1$ through $Y_n$ and the X-electrode lines $X_1$ through $X_n$ shown in FIG. 1. In this scenario, an apparatus 50 for driving the PDP includes a subfield sustain pulse number calculator 53 and a sustain pulse number controller 54.

The subfield sustain pulse number calculator 53 calculates a number of sustain pulses for each subfield in a current frame using a total number of sustain pulses in the current frame and grayscale weights allocated to the respective subfields in the current frame, thus obtaining a calculated sustain pulse number having an integral part and a fractional part. The sustain pulse number controller 54 may include a sustain pulse number adjustor and a sustain pulse number determiner. The sustain pulse number adjustor in the sustain pulse number controller 54 adds a calculated sustain pulse number in a subfield included in the current frame and a fractional part of an adjusted sustain pulse number in a subfield having the same grayscale weight from a previous frame as the subfield in the current frame, thus obtaining an adjusted sustain pulse number in the current subfield for the current frame, which is made up of an integral part and a fractional part. The sustain pulse number determiner in the sustain pulse number controller 54 determines an integral part of the adjusted sustain pulse number in the current subfield as a number of sustain pulses applied to each of the Y-electrode lines $Y_1$ through $Y_n$ and the X-electrode lines $X_1$ through $X_n$, i.e., an applied sustain pulse number, in the current subfield. The sustain pulse number determiner arrives at the applied sustain pulse number preferably by truncating off the fractional part of the adjusted sustain pulse number and using only the integral part of the adjusted sustain pulse number as the applied sustain pulse number. A driving-control signal generator 56 generates driving-control signals according to the applied sustain pulse number.

The apparatus 50 may further include a load ratio detector 51 detecting a load ratio on the current frame from input video data and a load-ratio sustain pulse number determiner 52 determining the total number of sustain pulses for the entire frame as being proportional to the reciprocal of the load ratio. Here, the load ratio is a ratio of a number of cells to be turned on in the current frame to a total number of the cells on the PDP.

A subfield controller 55 outputs grayscale weight information for each of the subfields in the current frame. In the embodiment of the present invention, grayscale weights are predetermined for subfields, respectively, and the subfields are configured according to the predetermined grayscale weights. However, when necessary, for example, to achieve a fine display in a low grayscale region, the subfield controller 55 may be designed to adjust the grayscale weights for the respective subfields.

The apparatus 50 performs the method illustrated by FIGS. 8 and 9. Accordingly, a description of functions performed by the apparatus 50 has been described above with respect to FIGS. 8 and 9. Thus, a detailed description of operations of the apparatus 50 will be omitted.

Figure 11:
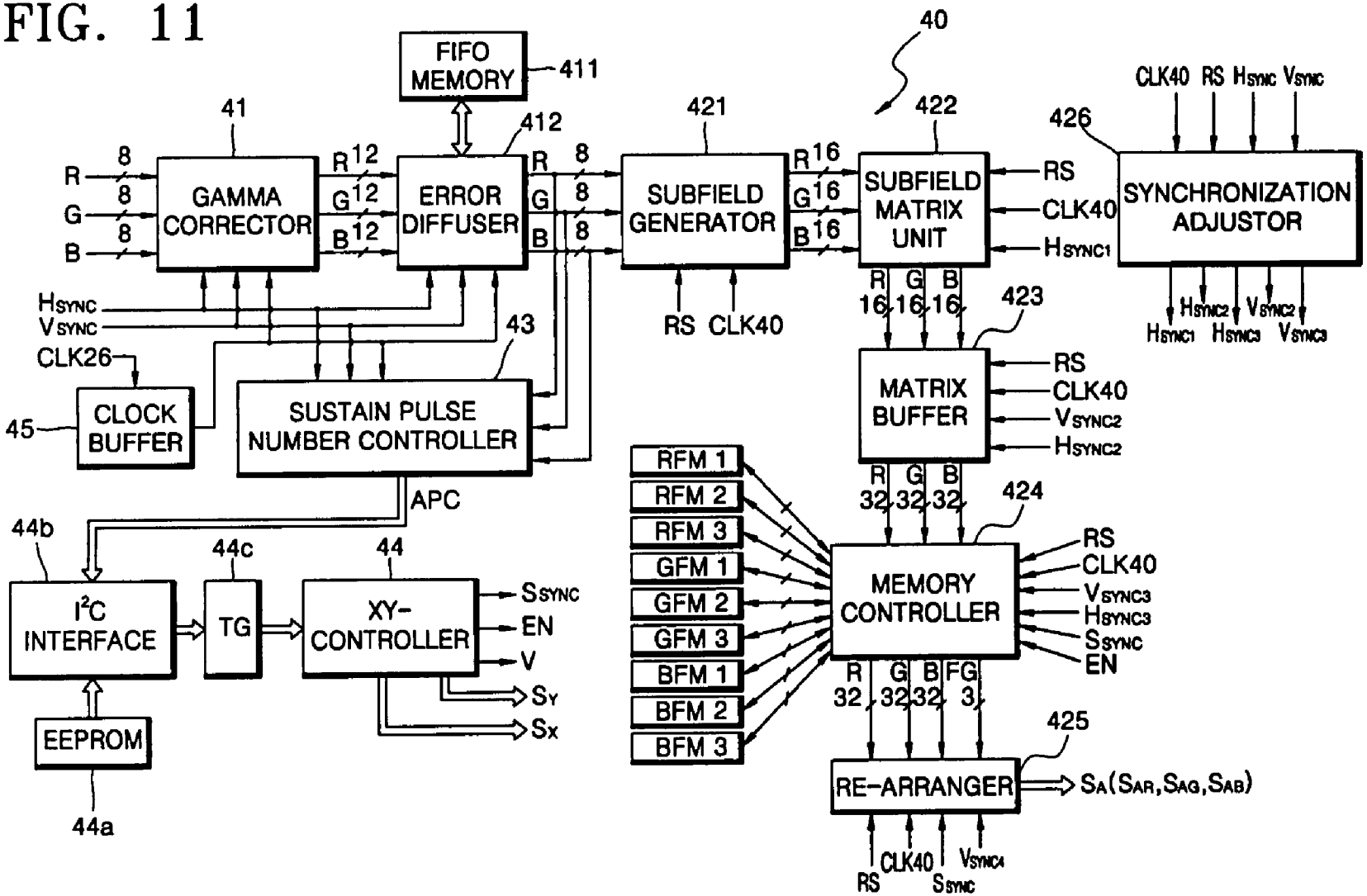
FIG. 11 is a schematic block diagram of an apparatus for driving a PDP, that uses the method of FIG. 8, according to another embodiment of the present invention.

FIG. 11 is a schematic block diagram of an apparatus for driving a PDP, by which the method shown in FIG. 8 is performed, according to another embodiment of the present invention. The method performed using an apparatus 40 for driving a PDP shown in FIG. 11 may be performed in the logic controller 22 of apparatus 2 of FIG. 3. Referring to FIG. 11, the apparatus 40, i.e., the logic controller, includes a clock buffer 45, a synchronization adjustor 426, a gamma corrector 41, an error diffuser 412, a first-in first-out (FIFO) memory 411, a subfield generator 421, a subfield matrix unit 422, a matrix buffer 423, a memory controller 424, frame memories RFM1 through BFM3, a re-arranger 425, a sustain pulse number controller 43, an EEPROM (electrically erasable programmable read-only memory) 44*a*, an $I^2C$ interface 44*b*, a timing-signal generator (TG) 44*c*, and an XY-controller 44.

The clock buffer 45 converts a 26 MHz clock signal CLK26 from the video processor 26 shown in FIG. 3 into a 40 MHz clock signal CLK40. The synchronization adjustor 426 receives the 40 MHz clock signal CLK40 from the clock buffer 45, a reset signal RS from an outside, and a horizontal synchronizing signal HSYNC and a vertical synchronizing signal VSYNC from the video processor 26. The synchronization adjustor 426 outputs horizontal synchronizing signals $H_{SYNC1}$, $H_{SYNC2}$, and $H_{SYNC3}$ which are obtained by delaying the horizontal synchronizing signals $H_{SYNC}$ by predetermined numbers, respectively, of clock pulses and outputs vertical synchronizing signals $V_{SYNC1}$, $V_{SYNC2}$, and $V_{SYNC3}$ which are obtained by delaying the vertical synchronizing signals $V_{SYNC}$ by predetermined numbers, respectively, of clock pulses.

Video data R, G, and B input into the gamma corrector 41 have a non-linear reverse input/output characteristic to compensate for a non-linear input/output characteristic of a cathode-ray tube (CRT). Accordingly, the gamma corrector 41 processes the video data R, G, and B to have a linear input/output characteristic. The error diffuser 412 moves a position of a most significant bit (MSB) that is a border bit of each of the video data R, G, and B using the FIFO memory 411 to reduce a data transmission error.

The subfield generator 421 converts 8-bit video data R, G, and B to have many bits as corresponding to a number of subfields included in a single frame. For example, when a single frame includes 14 subfields to display a grayscale, the subfield generator 421 converts the 8-bit video data R, G, and B into 14-bit video data R, G, and B and adds invalid data having a value of "0" to the 14-bit video data R, G, and B as an MSB and a least significant bit (LSB), thus outputting 16-bit video data R, G, and B.

The subfield matrix unit 422 rearranges the 16-bit video data R, G, and B including data for different subfields to simultaneously output data for the same subfield. The matrix buffer 423 processes the 16-bit video data R, G, and B to output 32-bit video data R, G, and B.

The memory controller 424 includes a red memory controller that controls the three frame memories RFM1, RFM2, and RFM3 for red color, a green memory controller that controls the three frame memories GFM1, GFM2, and GFM3 for green color, and a blue memory controller that controls the three frame memories BFM1, BFM2, and BFM3 for blue color. The memory controller 424 continuously outputs frame data in units of frames to the re-arranger 425. A reference character EN denotes an enable signal that is generated by the XY-controller 44 and input to the memory controller 424 to control the data output of the memory controller 424. A reference character $S_{SYNC}$ denotes a slot synchronizing signal that is generated by the XY-controller 44 and input to the memory controller 424 and the re-arranger 425 to respectively control the data output and input of the memory controller 424 and the re-arranger 425 in units of 32-bit slots. The re-arranger 425 rearranges the 32-bit video data R, G, and B from the memory controller 424 in accordance with an input format for the address driver 23 shown in FIG. 3.

Meanwhile, the sustain pulse number controller 43 detects an average signal level (ASL) from the 8-bit video data R, G, and B received from the error diffuser 412 in units of frames and generates discharge number control data APC corresponding to the ASL, thus performing automatic power control to uniformize power consumption in each frame. A load ratio indicates an average of load ratios in respective subfields in one frame. A load ratio in each subfield is a ratio of a number of display cells to be turned on to a number of all of the cells on the PDP 1 shown in FIG. 1.

The EEPROM 44*a* stores timing control data in accordance with a driving sequence of the X-electrode lines $X_1$ through $X_n$ and the Y-electrode lines $Y_1$ through $Y_n$ shown in FIG. 1. The discharge number control data APC from the sustain pulse number controller 43 and the timing control data from the EEPROM 44*a* are input to the TG 44*c* via the $I^2C$ interface 44*b*. The TG 44*c* operates according to the discharge number control data APC and the timing control data and generates a timing-signal. The XY-controller 44 operates according to the timing-signal from the TG 44*c* and outputs an X-driving control signal $S_X$ and a Y-driving control signal $S_Y$.

FIG. 12 is a schematic graph illustrating automatic power control performed by the apparatus shown in FIG. 10 or 11. Referring to FIG. 12, according to the automatic power control, a number of sustain pulses applied to sustain electrode line pairs on a PDP during a sustain period in a frame is controlled according to a load ratio, that is, a ratio of a number of cells to be turned on to a total number of cells on the PDP. Here, the number of sustain pulses in a frame is in inverse proportion to (i.e., proportional to the reciprocal of) a load ratio in the frame. In other words, when a load ratio in a frame is small, a number of sustain pulses in the frame may be increased, thus increasing brightness of a displayed image. When a load ratio in a frame is great, a number of sustain pulses in the frame may be decreased, thus reducing power consumption. In the graph shown in FIG. 12, when a load ratio is L1, a number of sustain pulses in a frame is N1. When the load ratio is decreased to L2, the number of sustain pulses is increased to N2. When the load ratio is L4, the number of sustain pulses is N4. Consequently, the number of sustain pulses is in inverse proportion to the load ratio in a frame.

According to the present invention, an error of a fractional part occurring in a result of calculating a number of sustain pulses in a subfield in a current frame is added to a number of sustain pulses calculated in the same subfield in a subsequent frame, thus compensating for distortion in a grayscale caused by the error of the fractional part. As a result, grayscale display capability is enhanced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of driving a plasma display panel (PDP), the method comprising:

providing the PDP comprising sustain electrode line pairs comprising X-electrode lines and Y-electrode lines arranged parallel to each other in an alternate manner, the PDP further comprising address electrode lines that cross the sustain electrode line pairs, thus forming cells at intersections therebetween;

dividing each frame of input video data into a plurality of subfields, each having unique grayscale weights, respectively, to perform time division grayscale display, each of the subfields comprising a reset period, an address period, and a sustain period during which a predetermined number of sustain pulses are alternately applied to the Y-electrode lines and the X-electrode lines; and applying a predetermined number of sustain pulses to the sustain electrode line pairs during the sustain period in each subfield, wherein the applying of the predetermined number of sustain pulses comprises:

calculating a number of sustain pulses for each subfield in a current frame from both a total number of sustain pulses in the entire current frame and unique grayscale weights allocated to the respective subfields in the current frame, thus obtaining a calculated sustain pulse numbers for each subfield, each calculated sustain pulse number comprising an integral part and a fractional part;

adding to the calculated sustain pulse number in the subfield included in the current frame a fractional part of an adjusted sustain pulse number in a subfield having the same unique grayscale weight in a previous frame as the subfield in the current frame, thus obtaining an adjusted sustain pulse number in the subfield in the current frame, the adjusted sustain pulse number comprises an integral part and a fractional part;

determining a number of sustain pulses to be applied to each of the Y-electrode lines and the X-electrode lines in the subfield in the current frame from the integral part of the adjusted sustain pulse number in the subfield in the current frame; and applying to said Y-electrode lines and said X-electrode lines in said subfield of said current frame said number of sustain pulses determined from the integral part of the adjusted sustain pulse number in the subfield of the current frame.

2. The method of claim 1, wherein the applying of the predetermined number of sustain pulses further comprises:

detecting a load ratio of a number of cells to be turned on to a total number of the cells on the PDP from the input video data; and calculating the total number of sustain pulses for the entire current frame from the detected load ratio, the total number of sustain pulses for the entire current frame being proportional to the inverse of the detected load ratio.

3. The method of claim 2, wherein the calculated sustain pulse number in the subfield in the current frame is obtained by multiplying the total number of sustain pulses in the current frame by the unique grayscale weight allocated to the subfield and dividing a result of the multiplication by a sum of the unique grayscale weight of each of the respective subfields in the current frame.

4. The method of claim 1, the determining a number of sustain pulses to be applied is accomplished by truncating off the fractional part of the adjusted sustain pulse number from the integral part.

5. An apparatus of driving a plasma display panel (PDP), comprising:

sustain electrode line pairs comprising X-electrode lines and Y-electrode lines in an alternating manner and in parallel with each other, and address electrode lines arranged to cross the sustain electrode line pairs to form cells at intersections therebetween, the apparatus being configured to divide each frame of input video data into a plurality of subfields, each subfield having unique grayscale weights, respectively, to perform time division grayscale display, each of the subfields comprising a reset period, an address period, and a sustain period during which a predetermined number of sustain pulses are alternately applied to the Y-electrode lines and the X-electrode lines, and applying a predetermined number of sustain pulses to the sustain electrode line pairs during the sustain period in each subfield;

a subfield sustain pulse number calculator adapted to calculate a number of sustain pulses for each subfield in a current frame using a total number of sustain pulses in the current frame and the unique grayscale weights allocated to each of the respective subfields in the current frame, thus obtaining a calculated sustain pulse number that comprises an integral part and a fractional part;

a sustain pulse number adjustor adapted to calculate an adjusted sustain pulse number for each subfield by adding to the calculated sustain pulse number in the subfield included in the current frame a fractional part of an adjusted sustain pulse number in a subfield having the same unique grayscale weight in a previous frame as the subfield in the current frame, thus obtaining an adjusted sustain pulse number in the subfield in the current frame that comprises an integral part and a fractional part;

a sustain pulse number determiner adapted to determine a number of sustain pulses to be applied to each of the Y-electrode lines and the X-electrode lines in the subfield in the current frame from the integral part of the adjusted sustain pulse number in the subfield in the current frame; and a driving control signal generator adapted to generate driving control signals and apply them to said sustain electrode line pairs according to said determined number of sustain pulses to be applied.

6. The apparatus of claim 5, further comprising:

a load ratio detector adapted to detect a load ratio from the input video data, the load ratio being equal to a number of cells to be turned on to a total number of the cells on the PDP; and a load-ratio sustain pulse number determiner adapted to determine the total number of sustain pulses in the current frame by taking the reciprocal of the detected load ratio.

7. A method, comprising:

providing a PDP comprising sustain electrode line pairs, the PDP further comprising address electrode lines that cross the sustain electrode line pairs, thus forming cells at intersections therebetween;

receiving input video data;

dividing each frame of input video data into a plurality of subfields, each subfield having unique grayscale weights, respectively, to perform time division grayscale display, each of the subfields comprising a reset period, an address period, and a sustain period, a predetermined number of sustain pulses being applied to the sustain electrode line pairs for each subfield;

calculating a calculated number of sustain pulses to be applied for each subfield in a current frame from the grayscale weights, said calculated number comprising a whole number part and a fractional part;

modifying the calculated number for each subfield by adding a fractional part of a modified calculated number from an corresponding subfield in a previous frame to the calculated number for each subfield in the current frame to arrive at a modified calculated number of sustain pulses for each subfield in the current frame;

truncating the modified calculated number to arrive at the actual number of sustain pulses to be applied during the sustain period of the subfield;

applying the actual number of sustain pulses to be applied during the sustain period of the subfield to the sustain electrode line pairs during the sustain period of the subfield; and repeating the above for each of the remaining sub fields in the current frame.

8. The method of claim 7, the corresponding subfield in a previous frame being determined by a subfield in the previous frame that has the same grayscale weight as a subfield in the current frame.

9. The method of claim 7, further comprising:

detecting a load ratio of a current frame from the input video signal; and calculating a total number of sustain pulses for the current frame from the reciprocal of the load ratio.

10. The method of claim 9, the calculated number of sustain pulses for a subfield in the current frame being the product of the total number of sustain pulses for the current frame and the grayscale weight for the subfield.

* * * * *